US007371091B2

(12) United States Patent
Kojori

(10) Patent No.: US 7,371,091 B2
(45) Date of Patent: May 13, 2008

(54) METHOD AND APPARATUS FOR INTEGRATED HOT SWAP CONNECTOR PINS FOR AC AND DC ELECTRIC POWER SYSTEMS

(75) Inventor: Hassan Ali Kojori, Mississauga (CA)

(73) Assignee: Honeywell International, Inc., Morristown, NJ (US)

( * ) Notice: Subject to any disclaimer, the term of this patent is extended or adjusted under 35 U.S.C. 154(b) by 40 days.

(21) Appl. No.: 11/472,483

(22) Filed: Jun. 22, 2006

(65) Prior Publication Data

US 2007/0298638 A1 Dec. 27, 2007

(51) Int. Cl.
*H01R 13/53* (2006.01)

(52) U.S. Cl. ..... 439/181

(58) Field of Classification Search ..... 439/181, 439/886, 668, 669

See application file for complete search history.

(56) References Cited

U.S. PATENT DOCUMENTS

| | | | |
|---|---|---|---|
| 4,510,533 | A | 4/1985 | Tokuyama |
| 4,747,783 | A | 5/1988 | Bellamy et al. |
| 5,213,517 | A | 5/1993 | Kerek et al. |
| 5,568,610 | A | 10/1996 | Brown |
| 5,802,328 | A | 9/1998 | Yoshimura |
| 5,881,251 | A | 3/1999 | Fung et al. |
| 5,996,035 | A | 11/1999 | Allen et al. |
| 6,121,693 | A | 9/2000 | Rock |
| 6,172,303 | B1 | 1/2001 | Naegelin et al. |
| 6,232,676 | B1 | 5/2001 | Kozyra et al. |
| 6,296,499 | B1 | 10/2001 | Hermann, Jr. et al. |
| 6,353,523 | B1 | 3/2002 | Niv et al. |
| 6,400,203 | B1 | 6/2002 | Bezzi et al. |
| 6,447,309 | B1 | 9/2002 | Ko et al. |
| 6,459,600 | B2 | 10/2002 | Farrington et al. |
| 6,522,515 | B1 | 2/2003 | Whitney |
| 6,526,466 | B1 | 2/2003 | Frake et al. |
| 6,574,695 | B1 | 6/2003 | Mott et al. |
| 6,604,916 | B2 | 8/2003 | Lu et al. |

(Continued)

FOREIGN PATENT DOCUMENTS

| | | |
|---|---|---|
| JP | 3-20978 A | 1/1991 |

(Continued)

OTHER PUBLICATIONS

"Introduction to Hot Swap," Texas Instruments; Jonathan M. Bearfield; TechOnLine Publication Date: Sep. 24, 2001.

*Primary Examiner*—Tho D. Ta
(74) *Attorney, Agent, or Firm*—Oral Caglar, Esq.

(57) ABSTRACT

Methods and apparatuses are used for AC and DC electric power systems. The apparatus according to one embodiment is a pin system (180A) for AC and DC electric power systems which comprises a female pin (418), the female pin (418) comprising a resistive region (405), the resistive region (405) forming a first portion of an inner surface of the female pin (418), and a conductive region (406), the conductive region (406) forming a second portion of the inner surface of the female pin (418), the conductive region (406) contacting the resistive region (405), the conductive region (406) being located further than the resistive region (405) from an open end of the female pin (418); and a male pin (415) adapted to be inserted in the female pin (418) along the inner surface of the female pin (418), the male pin (415) being made of a conductive material.

20 Claims, 5 Drawing Sheets

U.S. PATENT DOCUMENTS

| | | | | |
|---|---|---|---|---|
| 6,623,288 | B2 | 9/2003 | Sakiyama et al. | |
| 6,636,919 | B1 | 10/2003 | Huth | |
| 6,654,843 | B1 | 11/2003 | Wakeley et al. | |
| 6,704,825 | B1 | 3/2004 | Lascu et al. | |
| 6,729,897 | B2 | 5/2004 | Lai | |
| 6,771,478 | B2 | 8/2004 | Ochi | |
| 6,802,729 | B2 * | 10/2004 | Hermann et al. | 439/181 |
| 6,810,458 | B1 | 10/2004 | Bazargan et al. | |
| 6,850,048 | B2 | 2/2005 | Orr et al. | |
| 6,857,887 | B1 * | 2/2005 | Belson et al. | 439/181 |
| 6,896,541 | B2 | 5/2005 | Benson | |
| 6,955,551 | B2 * | 10/2005 | Yamamoto | 439/181 |
| 2004/0161966 | A1 | 8/2004 | Benson | |
| 2005/0191887 | A1 | 9/2005 | Hsieh | |
| 2005/0215110 | A1 | 9/2005 | Chen | |
| 2005/0266723 | A1 | 12/2005 | Graham et al. | |

FOREIGN PATENT DOCUMENTS

| | | | |
|---|---|---|---|
| JP | 3-220788 | A | 9/1991 |
| WO | WO-2004/047233 | A1 | 6/2004 |

* cited by examiner

METHOD AND APPARATUS FOR INTEGRATED HOT SWAP CONNECTOR PINS FOR AC AND DC ELECTRIC POWER SYSTEMS

CROSS REFERENCE TO RELATED APPLICATIONS

This non-provisional application is related to co-pending non-provisional applications titled "Method and Apparatus for Hot Swap of Line Replaceable Modules for AC and DC Electric Power Systems" and "Method and Apparatus for Integrated Active-Diode-ORing and Soft Power Switching", the entire contents of which are hereby incorporated by reference.

BACKGROUND OF THE INVENTION

1. Field of the Invention

The present invention relates to connector pin systems, and more particularly to a method and apparatus for hot swap of modules using connector pin systems.

2. Description of the Related Art

Electric systems used in complex environments such as aerospace systems, more electric aircraft systems, industrial environments, vehicles, etc., include a large number of electric modules. Various electric modules may need to be extracted and replaced with other electric modules, to change functionality or to replace electric modules that exhibit faults.

Hot swap, hot-plug, and hot-dock are terms used interchangeably to refer to the process of safely inserting or removing cards, PC boards, cables, and/or modules from a host system without removing power. The goal of hot swap is to insert or remove modules without disturbing, damaging, or degrading up/down-stream adjacent line replaceable modules/subsystems, to increase system availability, reduce down time, simplify system repair, and allow for system maintenance/upgrade without interrupting service to other loads.

If not designed for properly, hot swap can cause severe electrical, mechanical, thermal and operational problems in an electrical system. For example, random pin arcing may occur during the mating process of a replaceable module with its parent electrical system. Pulling a board/module out while there is current passing through the module connectors, or inserting a board/module with all bulk/bypass capacitors at zero volts, can introduce severe electrical voltage/current transients which may adversely impact reliability and lead to safety consequences. For example, current chopping introduces Ldi/dt variations (where L is inductance of a load, for example) leading to very large voltage transients which are a major safety concern for maintenance people, as large voltage transients can cause high voltage electrical shock.

Multiple long/short pin arrangements are used in typical/conventional hot swap of replaceable modules. One such pin arrangement is described in "*Introduction to Hot Swap*", by Jonathan M. Bearfield, Texas Instruments, TechOnLine, publication date Sep. 24, 2001. In this publication, a hot swap system for hot swap of modules includes a connector with long and short pins, a fuse, and an RC circuit. During hot swap of a module, the long pins mate first, adding the RC circuit to pre-charge the module/board. When the board/module is fully inserted, the short pins mate, bypassing the resistor connected to the longer pins and creating a low impedance connection. One problem associated with long/short pin arrangements is the increase in number of pins needed for hot swap. Presence of more pins for hot swap leads to increased cost and weight of systems using such hot swap pin arrangements. A second problem associated with long/short pin arrangements for hot swap is lack of control in the timing of pin insertion and extraction during hot swap.

Some techniques to integrate long and short pins have been studied. One such technique is described in U.S. Pat. No. 4,747,783 titled "Resistive Pin for Printed Circuit Card Connector", by P. D. Bellamy et al. In the technique described in this patent, a male connector pin is made of a conductive material, an outer layer of resistive material, and a layer of insulating material. The outer layer of resistive material is deposited on a first portion of the conductive material. The insulating layer separates the resistive layer from the conductive material. As the pin is inserted into an electrical socket, socket contacts travel first along the resistive portion of the pin, and then along the conductive portion of the pin. In this technique, however, the length of the socket-contacted resistive region of the pin increases to a maximum, before the socket contacts reach the conductive region of the pin. Hence, the resistance of the connector pin increases to a maximum, after which abruptly drops to zero, which leads to a non-uniform and not well controlled hot swap process. Moreover, a pin system as described in the above mentioned patent is difficult to manufacture and is not cost-effective, due to the configuration of layers on the pin connector.

A disclosed embodiment of the application addresses these and other issues by utilizing an integrated hot swap connector pin system that includes a conductive male pin, and a female pin with a resistive region, an insulating region, and a conductive region. The method and apparatus produce a gradually decreasing resistance as the male pin is inserted into the female pin, hence eliminating in-rush currents during hot swap insertion of a replaceable module into a live power board. The method and apparatus produce a gradually increasing resistance as the male pin is extracted from the female pin, hence reducing current chopping during hot swap extraction of a replaceable module from a live power board. The method and apparatus prevent random pin arcing during mating process by reducing the AC or DC current during the MAKE or BREAK process; eliminate in-rush currents during initial insertion of a board/module with all bulk/bypass capacitors at zero volts; eliminate large electrical voltage/current transients, such as large voltage transients due to Ldi/dt current chopping variations, which may adversely impact reliability and lead to safety consequences; provide a uniform and well controlled hot swap of replaceable modules and boards.

SUMMARY OF THE INVENTION

The present invention is directed to methods and apparatuses for AC and DC electric power systems. According to a first aspect of the present invention, a pin system for AC and DC electric power systems comprises: a female pin, the female pin comprising a resistive region, the resistive region forming a first portion of an inner surface of the female pin, and a conductive region, the conductive region forming a second portion of the inner surface of the female pin, the conductive region contacting the resistive region, the conductive region being located further than the resistive region from an open end of the female pin; and a male pin adapted to be inserted in the female pin along the inner surface of the female pin, the male pin being made of a conductive material.

According to a second aspect of the present invention, an apparatus for hot swap of AC or DC line replaceable modules comprises: a pin system, the pin system being connectable to a replaceable module and connectable to a backplane, the pin system comprising a female pin connectable to the backplane, the female pin comprising a resistive region forming a first portion of an inner surface of the female pin, and a conductive region forming a second portion of the inner surface of the female pin, the conductive region contacting the resistive region, the conductive region being located further than the resistive region from an open end of the female pin, and a male pin adapted to be inserted in the female pin along the inner surface of the female pin, the male pin being made of a conductive material, and the male pin being connectable to the replaceable module, wherein resistance of the pin system decreases in a continuous manner as the male pin is inserted into the female pin along the resistive region and the conductive region of the female pin; and a hot swap detector connectable to the pin system, the hot swap detector detecting disconnection of the replaceable module from the backplane, and detecting connection of the replaceable module to the backplane.

According to a third aspect of the present invention, a method for hot swap of AC or DC line replaceable modules comprises: providing a female pin for connection to a backplane, the female pin comprising a resistive region comprising a first hollow cylindrical shell forming a first portion of an inner surface of the female pin, and a conductive region comprising a second hollow cylindrical shell forming a second portion of the inner surface of the female pin, a start of a base of the conductive region contacting an end of a base of the resistive region, the conductive region being located further than the resistive region from an open end of the female pin; providing a male pin for connection to a line replaceable module, the male pin being adapted for insertion in the female pin along an inner hollow space of the female pin, the male pin being made of a conductive solid cylindrical material to fill the inner hollow space of the female pin; decreasing a resistance between the line replaceable module and the backplane in a continuous manner as the male pin is inserted into the female pin along the resistive region and the conductive region of the female pin; and increasing a resistance between the line replaceable module and the backplane in a continuous manner as the male pin is extracted from the female pin along the conductive region and the resistive region of the female pin.

According to a fourth aspect of the present invention, a method for hot swap of AC or DC line replaceable modules comprises: providing a female pin for connection to a backplane; providing a male pin for connection to a line replaceable module, the male pin adapted to be inserted in the female pin; decreasing a resistance between the line replaceable module and the backplane in a continuous manner as the male pin is inserted into the female pin along a resistive region of the female pin and a conductive region of the female pin; and increasing a resistance between the line replaceable module and the backplane in a continuous manner as the male pin is extracted from the female pin along the conductive region and the resistive region of the female pin.

BRIEF DESCRIPTION OF THE DRAWINGS

Further aspects and advantages of the present invention will become apparent upon reading the following detailed description in conjunction with the accompanying drawings, in which.

DETAILED DESCRIPTION

Figure 1:
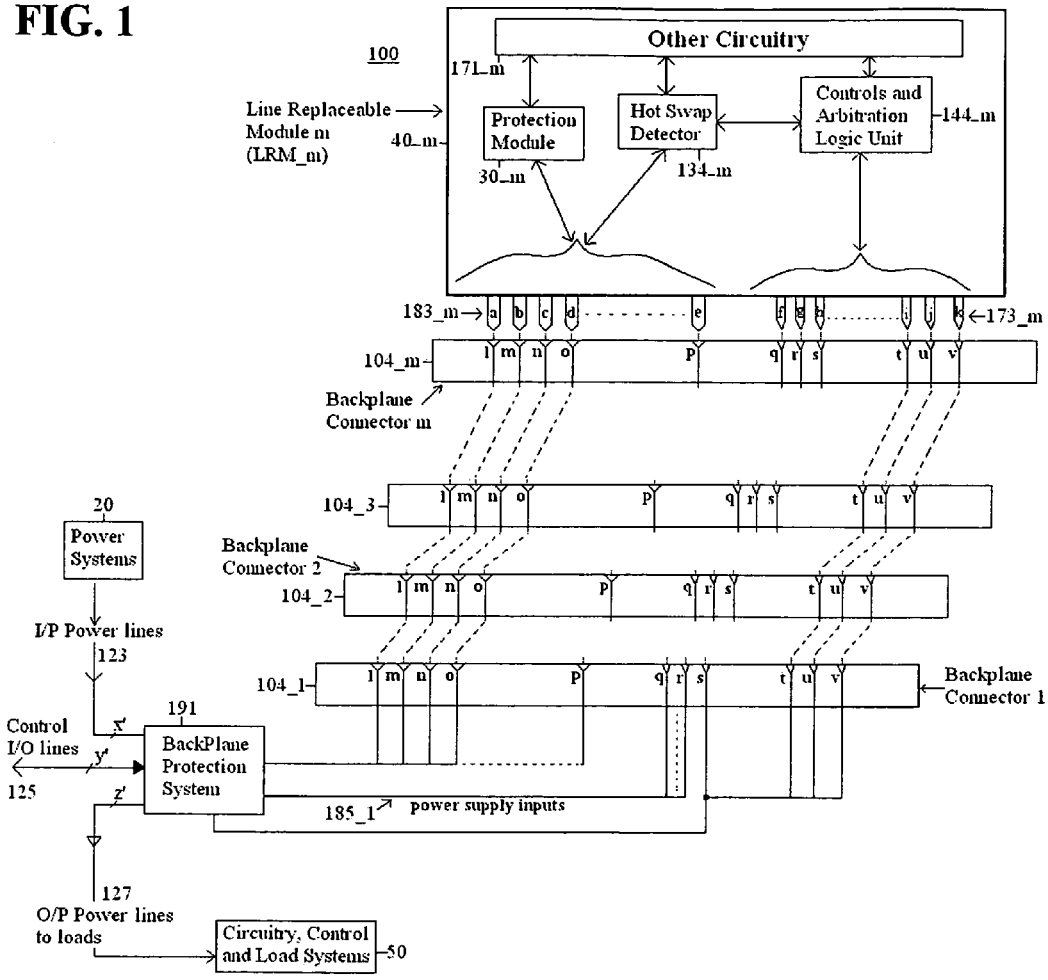
FIG. 1 is a general functional block diagram of a subassembly electrical system containing line replaceable modules (LRMs) with hot-swap capability according to an embodiment of the present invention.

Aspects of the invention are more specifically set forth in the accompanying description with reference to the appended figures. FIG. 1 is a general functional block diagram of a subassembly electrical system containing line replaceable modules (LRMs) with hot-swap capability according to an embodiment of the present invention. The electrical system 100 illustrated in FIG. 1 includes the following components: power systems 20; m line replaceable modules (LRMs) 40_1, . . . , 40_*m* of which only LRM 40_*m* is shown; circuitry, control and load systems 50; m backplane connectors 104_1, 104_2, . . . , 104_*m;* and a backplane protection system 191. Operation of the electrical system 100 in FIG. 1 will become apparent from the following discussion.

LRM 40_*m* includes a protection module 30_*m;* a hot swap detector 134_*m;* other circuitry 171_*m;* a controls and arbitration logic unit 144_*m;* and pin systems 183_*m* and 173_*m*. Backplane connector 104_*m* includes pin systems that connect/disconnect from LRM 40_*m* pin systems, when LRM 40_*m* is inserted/extracted from backplane connector 104_*m*. Backplane connectors 104_1, 104_2, 104_3, etc. also connect or disconnect from LRMs 40_1, 40_2, 40_3, etc. (not shown). Other circuitry 171_*m* includes electronic and electric components of line replaceable module 40_*m,* such as transistors, resistors, connectors, switches, etc. Hot swap detector 134_*m,* protection module 30_*m,* and pin system 183_*m* perform hot swap protection functions during insertion or extraction of LRM 40_*m*. Controls and arbitration logic unit 144_*m* communicates with hot swap detector 134_*m* and with other circuitry 171_*m*.

Replaceable modules 40_1, 40_2, . . . , 40_*m* can be connected to and separated from backplane connectors 104_1, 104_2, . . . , 104_*m,* which provide electrical power to replaceable modules. Some LRMs may connect to two backplane/motherboard connectors, one connector for power-pins and one for low voltage power supply input and discrete I/O lines for controls, signal sensing, etc.

Power-in or power-out lines and other discrete signals may first be routed to the motherboard/backplane connectors. Then, when one LRM is attached to the corresponding mating backplane connector, proper power, control and power supply lines are connected from the backplane to the proper connector pins on the LRM, establishing the right connections (achieved by design) to get the desired functionality provided by that particular LRM.

Backplane connectors 104_1, 104_2, . . . ,104_*m* connect to backplane protection system 191. Backplane protection system 191 includes electric and electronic components such as switches, fuses, circuit breakers, resistors, etc., for protection of the backplane connectors. Input I/P power lines 123 lead into backplane protection system 191 and provide power from power systems 20. Control I/O lines 125 transport control I/O data in and out from backplane protection system 191, hence communicating control I/O data to replaceable modules 40_1, 40_2, . . . , 40_*m*. Output O/P power lines 127 leave backplane protection system 191 and connect to circuitry, control and load systems 50.

Protection module 30_*m* protects replaceable module 40_*m* and backplane connector 104_*m* from in-rush currents during insertion of replaceable module 40_*m* into the backplane connector 104_*m* and electrical system 100, and from transient voltages and current chopping during extraction of replaceable module 40_*m* from backplane connector 104_*m* and electrical system 100. Protection module 30_*m* and pin system 183_*m* perform protection functions for replaceable module 40_*m*. Inside replaceable module 40_*m*, protection module 30_*m* and pin system 183_*m* protect other circuitry 171_*m*. Protection module 30_*m* and pin system 183_*m* also protect the power systems 20, the circuitry, control and load systems 50, during hot swap of replaceable module 40_*m*. Protection module 30_*m* and pin system 183_*m* protect components of electrical system 100 during hot swap insertion or removal of replaceable module 40_*m* under normal or faulty modes of operation for high voltage DC and AC systems without the need to disconnect power. Protection modules 30_*m* and pin system 183_*m* permit safe and reliable insertion and removal of different types of LRMs during hot swap, without disturbing, damaging, or degrading up/down-stream adjacent LRMs and subsystems of electrical system 100. Protection module 30_*m* and pin system 183_*m* also helps high voltage AC and DC load management LRMs to control the flow of electrical power to internal and external circuitry/loads and achieve proper protection of SSSDs or the wiring system.

Electrical system 100 may be associated with an aircraft, a more electric aircraft, a ship, a laboratory facility, a piece of industrial equipment, etc. The power systems 20 provide electrical energy in electrical system 100. The power systems 20 may include multiple power supply inputs, for redundancy. The power systems 20 may include AC and DC power supplies, electrical components such as transformers, inductances, resistances, etc. The power systems 20 may provide high DC or AC voltages or low DC or AC voltages to replaceable modules 40_1, 40_2, . . . , 40_*m*. Power systems 20 may provide and replaceable modules may use various AC voltages, such as, for example, 115V or 230V or higher, with fixed frequencies (such as, for example, 50/60 Hz or 400 Hz), or variable frequencies (such as, for example 360-800 Hz for aerospace applications), or DC voltages such as, for example, 28V or 270V. The power of replaceable module 40_*m* may depend on the number of channels, as well as current rating and voltage of each channel.

Replaceable modules 40_1, 40_2, . . . , 40_*m* receive electric power from power systems 20. Replaceable modules 40_1, . . . 40_*m* may be AC or DC Line Replaceable Modules (LRMs), cards, PC boards, etc. Replaceable modules 40_1, 40_2, . . . , 40_*m* may be high voltage AC and DC LRMs. Replaceable modules 40_1, 40_2, . . . , 40_*m* may have on-board Solid State Switching Devices (SSSDs). Replaceable modules 40_1, 40_2, . . . , 40_*m* may be high voltage Solid State AC and DC switches, referred to in the industry as Solid State Remote Power Controllers (SSPCs). Replaceable modules 40_1, 40_2, . . . , 40_*m* may be various types of LRMs such as: Power Supplies (PS-LRM), Digital Controllers (DC-LRM), AC Solid-State-Remote-Controller (AC-SSPC-LRM), DC Solid-State-Remote-Controller (DC-SSPC-LRM), LRMs used for aircraft platforms and More Electric platforms, PC boards or cards, etc. Solid State AC and DC switches can be used with a wide range of powers, from a few Watts to hundreds of KWatts. Replaceable modules 40_1, 40_2, . . . , 40_*m* including AC and DC Solid State Switching Devices (SSSDs) may manage high voltage AC and DC powers and loads, and may control the flow of electrical power to internal and external circuitry/loads, to achieve proper protection based on $i^2 \cdot t$ (instantaneous overcurrent protection for large currents and proportionally time-delayed overload protection for smaller currents) to protect the SSSDs or the wiring system.

Circuitry, control and load systems 50 receive electrical power through the replaceable modules, and use the electrical power downstream. Circuitry, control and load systems 50 may include various electrical systems, such as systems on an aircraft or ship, navigation systems, cabin systems, air conditioning systems, etc., systems in an industrial facility such as electrical equipment and tools, etc. Circuitry, control and load systems 50 may include power pins, DC and AC loads, electric circuits using DC and AC power that enable functioning of various services onboard a vehicle, or in a complex environment such as a laboratory facility. Services using AC and DC power may be an electric motor, an automatic braking system, a lighting system of a vehicle, a piece of industrial equipment, etc.

Each LRM among LRMs 40_1, 40_2, . . . , 40_*m*-1 (not shown) includes a protection module like protection module 30_*m* of LRM 40_*m*, and a pin system like pin system 183_*m*. Protection modules and pin systems ensure that hot swap of modules is properly done. Protection modules and pin systems avoid random pin arcing during mating process of a replaceable module to electrical system 100. Protection modules and pin systems provide protection for safely inserting a board/module when the board is not electrically initialized, and for safely pulling a board-out while there is current passing through connectors. When electrical system 100 includes integrated systems, protection modules and pin systems provide hot swap protection beyond local boundaries of the replaceable modules.

When boards/replaceable modules with multiple supply voltages are included in electrical system 100, proper power sequencing for the modules is performed. Protection modules mitigate hot swap effects, so that various bus activities & other operations taking place in electrical system 100 are not disturbed when hot swap of one or more replaceable modules is occurring. Together with control systems of electrical system 100, protection modules and pin systems help establish autonomy of subsystems in electrical system 100 and automatic system reconfiguration based on the type of replaceable modules extracted or inserted. Information needed to describe the LRM type can be hard-wired through adjustable jumper connectors and/or backed-up by S/W into non-volatile memory locations readable to processor units during LRM initialization.

Replaceable modules 40_1, 40_2, . . . , 40_*m* and the associated protection modules may be designed to provide electrostatic discharge (ESD) protection during hot swap, because electrostatic discharges can disable ports by destroying interface ICs, replaceable modules connections, and surrounding electrostatic sensitive subsystems.

Although the systems in electrical system 100 are shown as discrete units, it should be recognized that this illustration is for ease of explanation and that the associated functions of certain functional modules or systems can be performed by one or more physical elements.

Figure 2:
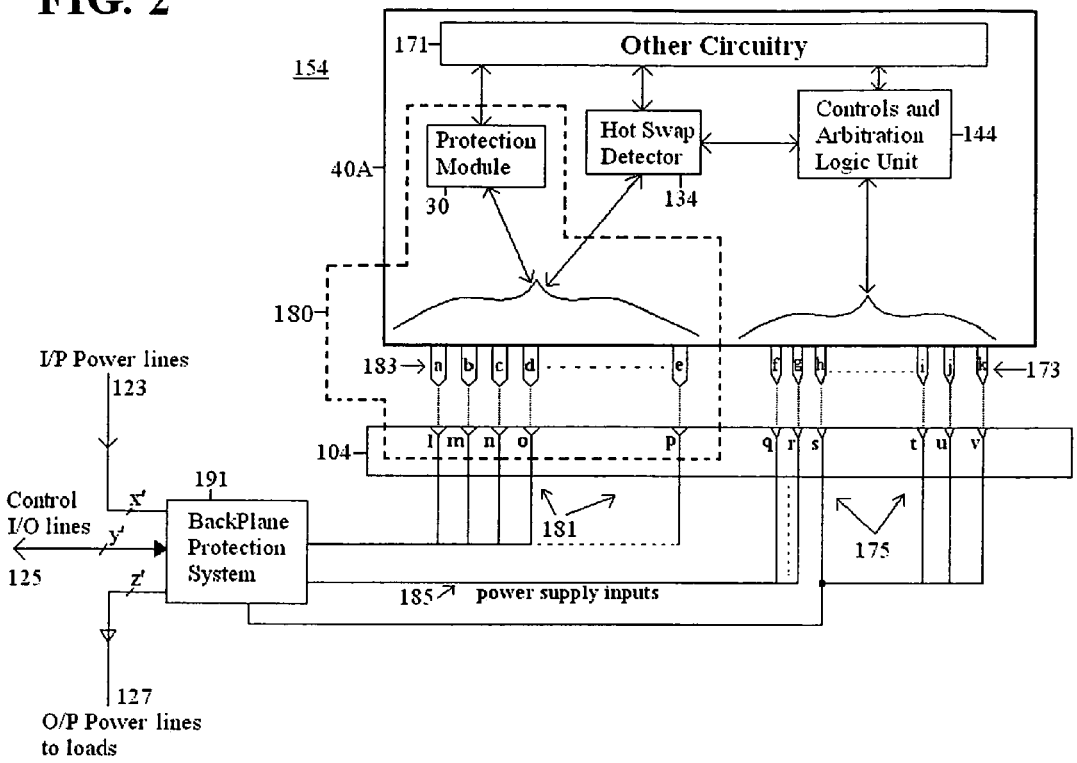
FIG. 2 is a block diagram of an electrical configuration containing an integrated hot swap connector pins arrangement for hot swap of line replaceable modules according to an embodiment of the present invention.

FIG. 2 is a block diagram of an electrical configuration 154 containing an integrated hot swap connector pins arrangement 180 for hot swap of line replaceable modules according to an embodiment of the present invention. The electrical configuration 154 illustrated in FIG. 2 includes the following components: a backplane 104; a replaceable module 40A; and a backplane protection system 191. The electrical configuration 154 is included in electrical system 100. Replaceable module 40A may be a line replaceable module (LRM), and includes: a protection module 30; a hot swap detector 134; other circuitry 171; a controls and arbitration logic unit 144; and pin systems 183 and 173. Backplane 104 includes pin systems 181 and 175. Other circuitry 171 includes electronic and electric components of line replaceable module 40A, such as transistors, resistors, connectors, switches, etc. Protection module 30, pin system 183, and pin system 181 form an integrated hot swap connector pins arrangement 180. The integrated hot swap connector pins arrangement 180 integrates the protection module 30 into the structure of pin systems 181 and 183. Hot swap detector 134 and integrated hot swap connector pins arrangement 180 perform hot swap protection functions.

Replaceable module 40A can be connected to and separated from backplane 104, which provides electrical power to replaceable module 40A. Replaceable module 40A connects and separates through pin systems 183 and 173 from backplane 104, at backplane pin systems 181 and 175. Backplane 104 provides electrical power to controls and arbitration logic unit 144 when pin systems 173 and 175 mate. Backplane 104 provides electrical power to protection module 30 and hot swap detector 134 when pin systems 183 and 181 mate.

Pin system 183 includes a number of pins, of which pins a, b, c, d, and e are shown. Pins of pin system 183 connect to protection module 30 and hot swap detector 134. Pin system 173 includes power supply and controls pins, of which pins f, g, h, i, j, and k are shown. Pins of pin system 173 connect to controls and arbitration logic unit 144. Controls and arbitration logic unit 144 also communicates with hot swap detector 134.

Backplane pin system 181 includes power pins of which pins l, m, n, o, and p are shown. Backplane pin system 181 connects to backplane protection system 191. Backplane protection system 191 includes electric and electronic components such as switches, fuses, circuit breakers, resistors, etc., for protection of backplane 104. Input I/P power lines 123 lead into backplane protection system 191. Control I/O lines 125 transport control I/O data in and out from backplane protection system 191, hence communicating control I/O data to replaceable module 40A. Output O/P power lines 127 leave backplane protection system 191 and connect to loads. Backplane pin system 175 includes power supply input pins q and r, and control pins and discrete I/O pins of which pins s, t, u, and v are shown. Power supply input pins q and r connect to backplane protection system 191 through power supply inputs 185. The control pins and discrete I/O pins of backplane pin system 175 also connect to backplane protection system 191.

The integrated hot swap connector pins arrangement 180 protects replaceable module 40A and backplane 104 from in-rush currents during insertion of replaceable module 40A into the backplane 104 and electrical system 100, and from transient voltages and current chopping during extraction of replaceable module 40A from backplane 104 and electrical system 100. Integrated hot swap connector pins arrangement 180 also protects other circuitry 171 inside replaceable module 40A.

During insertion or extraction of replaceable module 40A, electrical parameters associated with integrated hot swap connector pins arrangement 180 change. Hot swap detector 134 includes electronic circuitry (further described in FIG. 3) that senses changes in electrical parameters associated with integrated hot swap connector pins arrangement 180. Based on these changes, hot swap detector 134 detects whether a hot swap (insertion or extraction) of replaceable module 40A is being performed or has been completed. Hot swap detector 134 also detects changes in electrical parameters associated with other circuitry 171, changes which may occur during hot swap.

Controls and arbitration logic unit 144 receives reports from hot swap detector 134 about completion of hot swap of replaceable module 40A. When hot swap insertion of replaceable module 40A is completed, controls and arbitration logic unit 144 starts normal control and communication functions inside replaceable module 40A and at control pins and discrete I/O pins in pin systems 173 and 175.

Figure 3:
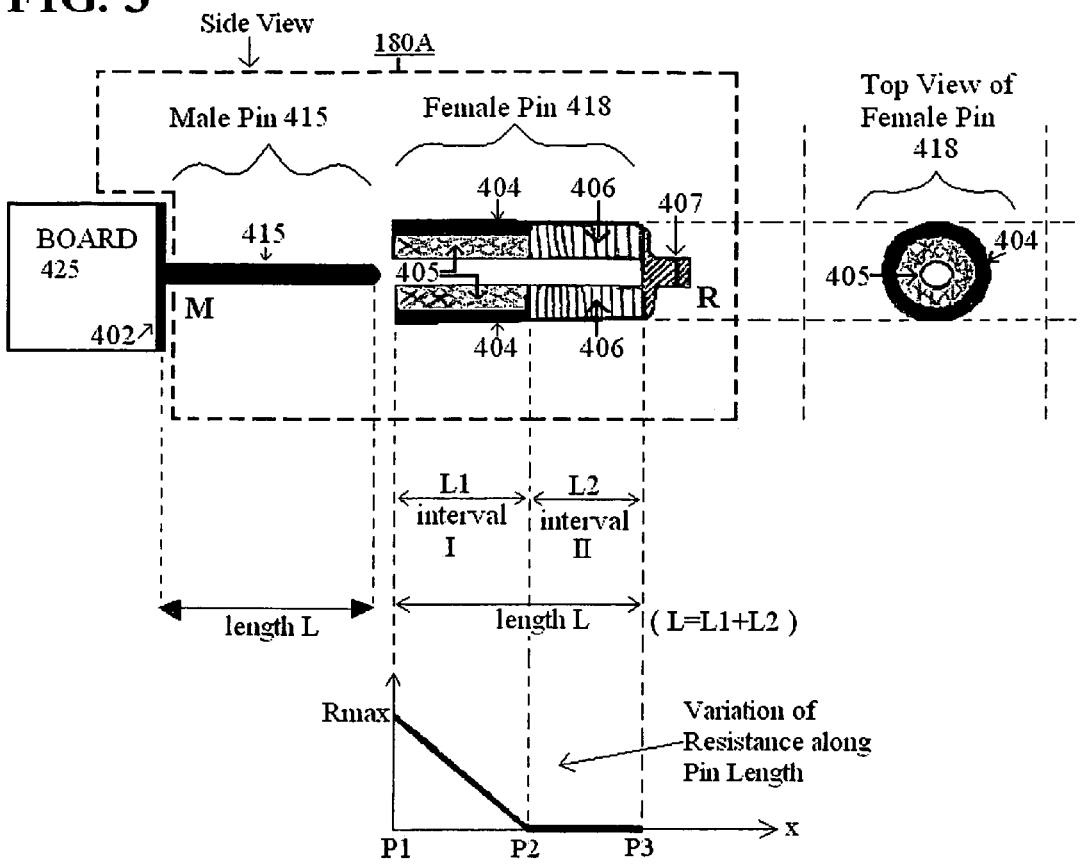
FIG. 3 illustrates an integrated hot swap connector pins arrangement for hot swap of line replaceable modules according to an embodiment of the present invention.

FIG. 3 illustrates an integrated hot swap connector pins arrangement 180A for hot swap of line replaceable modules according to an embodiment of the present invention. As illustrated in FIG. 3, integrated hot swap connector pins arrangement 180A includes a male pin 415 and a female pin 418. The male pin 415 is electrically connected to a board or replaceable module 425 along connection 402. The board 425 may be, for example, a replaceable module 40A as illustrated in FIG. 2. The length of the male pin 415 is L. The female pin 418 has two intervals, interval I and interval II. Interval I has length L1, and interval II has length L2. The total length of female pin 418 is equal to the length of the male pin 415, L1+L2=L. The interval I of female pin 418 includes an external insulating region 404, which covers an internal resistive cylindrical shell 405. The interval II of female pin 418 is a conductive shell 406. At the end of interval II, the conductive shell 406 connects to the end connection 407 for the female pin. The end connection 407 of the female pin typically connects to a motherboard/backplane. In the top view of female pin 418 in FIG. 3, the internal resistive cylindrical shell 405 inside the external insulating region 404 is illustrated.

A graph for resistance variation of integrated hot swap connector pins arrangement 180A along pin length is also shown at bottom in FIG. 3. When male pin 415 starts insertion into female pin 418 (makes gradual contact with interval I), the resistance of the integrated hot swap connector pins arrangement 180A between points M (base of male pin 415) and R (tip of female pin 418) is Rmax. Rmax is set by the internal resistive cylindrical shell 405. As the male pin 415 travels inside female pin 418 through interval I, the resistance of the integrated hot swap connector pins arrangement 180A gradually decreases, as shown in the resistance graph between points P1 and P2. The decrease of the resistance of pin arrangement 180A as the male pin 415 travels inside female pin 418 may be a linear function of distance, but other dependences on distance may also be implemented with nonlinear resistive materials for the internal resistive cylindrical shell 405. For example, the decrease of the resistance of pin arrangement 180A as the male pin 415 travels inside female pin 418 may be a non-linear function of distance, when the resistance of the internal resistive cylindrical shell 405 varies nonlinearly with distance along interval I.

When the male pin 415 has reached the end of interval I and makes contact with conductive shell 406 at the beginning of interval II, the resistance of the integrated hot swap connector pins arrangement 180A becomes zero, as the conductive shell 406 shorts out all the resistance of the female pin. As the male pin 415 travels further through interval II of female pin 418, the resistance of integrated hot swap connector pins arrangement 180A remains zero, as the male pin 415 remains in contact with conductive shell 406 throughout full insertion into female pin 418. Interval II conductive shell 406 ensures a good electrical connection for the male pin 415 to the female pin 418. The length of intervals I and II can be chosen depending on application and desired resistance variation for integrated hot swap connector pins arrangement 180A. The thicknesses of shells 404, 405, and 406 can be chosen depending on application and on desired behavior for integrated hot swap connector pins arrangement 180A.

A mechanical spring, not shown in FIG. 3, may be connected to male pin 415 or to female pin 418. The stiffness of the mechanical spring may be used to slow down the process of insertion and extraction of the male pin 415 from the female pin 418 through interval I of the female pin 418.

Variations to the hot swap connector pins arrangement 180A are possible. Variations to the hot swap connector pins arrangement 180A include, for example, integrating the resistive and insulating shells in a conductive shell for better mechanical and structural effectiveness of the hot swap connector pins arrangement.

In FIG. 3 only one integrated hot swap connector pins arrangement 180A is shown for board 425, but more integrated hot swap connector pins arrangements may be present. For example, a plurality of male pins like male pin 415 may be connected to board 425 along connection 402. A plurality of female pins like female pin 418 may then be present to connect to the plurality of male pins.

Figure 4:
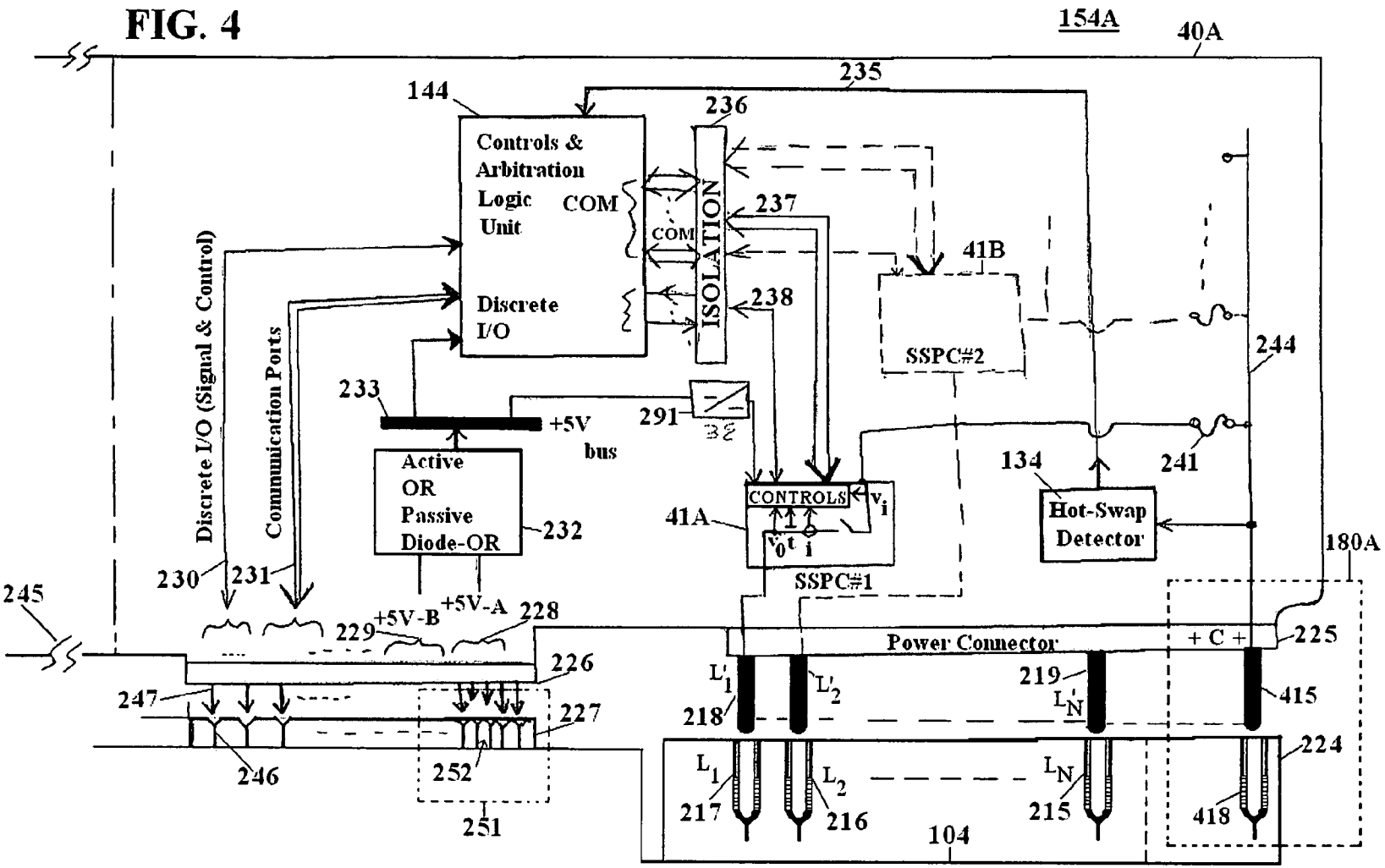
FIG. 4 is a block diagram illustrating an exemplary implementation of a hot swap protection system using an integrated hot swap connector pins arrangement according to an embodiment of the present invention illustrated in FIG. 3.

FIG. 4 is a block diagram illustrating an exemplary implementation of a hot swap protection system using an integrated hot swap connector pins arrangement 180A according to an embodiment of the present invention illustrated in FIG. 3. FIG. 4 shows how an integrated hot swap connector pins arrangement 180A can be used to prevent random pin arcing during the mating process by reducing the DC current during the MAKE (insertion) or BREAK (extraction) process for a DC LRM. Similar methods and apparatus apply for hot swap of AC type LRMs. The integrated hot swap connector pins arrangement 180A in FIG. 4 reduces the number of pins for a hot swap protection system, and integrates a hot swap resistor into the pin arrangement. The function of a hot swap resistor is performed by the internal resistive cylindrical shell 405 as described in FIG. 3.

FIG. 4 illustrates a DC Solid-State Remote Controller Line Replaceable Module (DC SSPC LRM) 40A included in an electrical configuration 154A. The DC SSPC LRM includes: high voltage Solid State DC switches, which are Solid State Power Controllers (SSPCs); a hot swap detector 134; a control and arbitration logic unit 144; an active or passive diode ORing system 232; a power connector 225, and a second power strip 226; and a plurality of pin systems connected to the power connectors. A few SSPCs are shown as SSPC #1 (element 41A) and SSPC#2 (element 41B). More SSPCs may be present but are not shown in the picture. The SSPCs are connected to electrical rail 244 through fuses. For example, SSPC#1 41A is connected to electrical rail 244 through fuse 241.

In the circuit shown in FIG. 4, the control logic voltage is applied first when a DC SSPC LRM is inserted during hot swap. The power pins are applied after the control logic voltage is applied. For protection during hot swap insertion of the DC SSPC LRM, it is desirable that the in-rush current be reduced and the resistance between the DC SSPC LRM and the system in which the LRM is being inserted be gradually decreased.

Power connector 225 connects to integrated hot swap connector pins arrangement 180A. Integrated hot swap connector pins arrangement 180A includes a male pin 415 and a female pin 418. The male pin 415 can communicate with the backplane 104 through female pin 418. Hot swap detector 134 connects to power connector 225 and bulk capacitors, and to male pin 415 of the integrated hot swap connector pins arrangement 180A. Bulk capacitors are typically present on the DC LRM. SSPC#1 41A also connects to male pin 415 of the integrated hot swap connector pins arrangement 180A.

Initially, during insertion of the DC SSPC LRM 40A into the host system, male pin 415 charges the bulk capacitors on the board. As male pin 415 is inserted into female pin 418, the resistance of integrated hot swap connector pins arrangement 180A gradually decreases, until male pin 415 gets shorted-out when it reaches the conductive shell of female pin 418. The initial resistance of interval I of female pin 418 reduces in-rush current during insertion of DC SSPC LRM 40A. When the male pin 415 is fully inserted into the female pin 418, the resistance of pin arrangement 180A becomes zero. Hot swap detector 134 detects the hot swap by detecting the voltage on the bulk capacitors, and informs the controls and arbitration logic unit 144, when the hot swap is completed (i.e., board fully inserted). Hot swap detector 134 communicates with the controls and arbitration logic unit 144 through line 235, and reports whether a hot swap is in progress or has been completed. After the hot swap is reported to be complete, controls and arbitration logic unit 144 communicates normally with SSPC#1 41A, through communication port 237 and discrete I/O signal and control port 238, through the isolation section 236. SSPC#1 41A also connects to the power connector 225 at male contact 218 $L'_1$, which connects to the backplane 104 at female contact 217 $L_1$. The pair of pins 218 and 217 can also be an integrated hot swap connector pins arrangement as illustrated in FIG. 3, with pin 218 being a solid conductive pin, and pin 217 being a female pin comprising a resistive cylindrical shell and a conductive cylindrical shell as shown in FIG. 3. A second SSPC #2 41B may similarly connect to the controls and arbitration logic unit 144, and to the backplane 104 at pin contacts $L'_2$ and $L_2$. An Nth SSPC #N may similarly connect to the controls and arbitration logic unit 144, and to the backplane 104 at male pin contact 219 ($L'_N$) and female contact 215 ($L_N$). The male and female pin pairs, such as $L'_2$ and $L_2$, . . . , $L'_N$ and $L_N$ can be integrated hot swap connector pins arrangements as illustrated in FIG. 3, with male pins $L'_2$, . . . , $L'_N$ being solid conductive pins, and the female pins $L_2$, . . . ,$L_N$ comprising resistive cylindrical shells and conductive cylindrical shells as shown in FIG. 3. The male pin 415 and the female pin 418 of integrated hot swap connector pins arrangement 180A provide power to DC SSPC LRM 40A from backplane 104 through electrical rail 244. The pin pairs $L'_1$ and $L'_1$, $L'_2$ and $L_2$, . . . , $L'_N$ and $L_N$ are used for routing power from the power bus from backplane 104 to various loads, through internal SSPC channels #1, #2, . . . , #N. Additional hot swap protection blocks may be present for backplane 104 connecting to female pins $L_2$, . . . ,$L_N$, or in DC SSPC LRM 40A connecting to power connector 225, as described in the co-pending non-provisional application titled "Method and Apparatus for Hot Swap of Line Replaceable Modules for AC and DC Electric Power Systems", the entire contents of which are hereby incorporated by reference.

In one embodiment, control power supply pins 228 and 229 may be part of a long/short pin assembly 251, as described in co-pending non-provisional application titled "Method and Apparatus for Hot Swap of Line Replaceable Modules for AC and DC Electric Power Systems", the entire contents of which are hereby incorporated by reference. In another embodiment, control power supply pins 228 and 229 may, together with female pins 252, be part of an integrated hot swap connector pins arrangement 251 as described in FIG. 3.

Reverse actions take place when a board is being pulled-out. For protection during hot swap extraction of a DC SSPC LRM, it is desirable that current chopping and transient voltages be avoided, with the resistance between the LRM and the system from which the LRM is extracted being gradually increased. Before physical break between the male pin 415 and the female pin 418, the resistance of integrated hot swap connector pins arrangement 180A gradually increases and goes to full resistance of interval I of female pin 418. Hence, the interruption current through the pins is significantly reduced by the resistance of the internal resistive cylindrical shell 405 of female pin 418. The interruption current is reduced to a negligible amount safe for extraction of DC SSPC LRM 40A. The internal resistive cylindrical shell 405 of female pin 418 connects to SSPC#1, SSPC#2, etc., through line 244. Hence, the integrated hot swap connector pins arrangement 180A performs hot swap protection.

The initial resistance Rmax of integrated hot swap connector pins arrangement 180A reduces the in-rush current when an LRM is inserted into a backplane. When an LRM is extracted from a backplane, the resistance of the integrated hot swap connector pins arrangement 180A gradually increases as male pin conductor 415 travels out of the female pin 418, and interruption current due to LRM extraction is reduced to a safe amount for the LRM and other subsystems of electrical system 100.

The internal resistive cylindrical shell 405 of female pin 418 connects to hot swap detector 134 as well, and hot swap detector 134 detects when extraction of SSPC #1 has been completed. The internal resistive cylindrical shell 405 of female pin 418 also contributes to detection of LRM insertion by hot swap detector 134. The gradually varying resistance of integrated hot swap connector pins arrangement 180A performs functions of protection module 30 illustrated in FIG. 2.

Block 232 provides passive or active diode ORing of a redundant power supply input from multiple power sources for the control power supply of the LRM. Block 232 allows connection of multiple power supply voltage inputs to realize a fault tolerant power supply bus for the LRM. Block 232 includes an integrated active-diode-OR circuit which provides soft power-up/down capability, avoids excessive power losses and voltage drops, and controls voltage/current transients and in-rush OR current chopping during LRM insertion/extraction respectively. Additional details about the passive or active diode ORing block 232 can be found in co-pending non-provisional application titled "Method and Apparatus for Integrated Active-Diode-ORing and Soft Power Switching", the entire contents of which are hereby incorporated by reference. Passive or active diode ORing block 232 connects to a 5V bus 233, which also connects to SSPC#1, and to the other SSPCs present on the DC SSPC LRM. Passive or active diode ORing block 232 communicates with controls and arbitration logic unit 144 at a discrete I/O port.

Unit 291 provides regulated DC-DC power conversion. In one exemplary implementation, unit 291 provides regulated DC-DC power conversion from 5V-to-5V, or from 5V-to-3.5V, etc. Unit 291 may also provide isolation if required.

The motherboard/backplane includes sections 227 and 224, which include mating connectors. The mating connectors 217, 216, 215, and 418 in section 224 are part of the motherboard/backplane and are fixed. DC SSPC LRM) 40A can be inserted or extracted from the motherboard/backplane.

As shown in FIG. 4, the integrated hot swap connector pins arrangement 180A is used for detection and proper mitigation of hot swap during insertion or extraction of LRM/boards. This arrangement eliminates in-rush currents during the initial insertion of a board/module with all bulk/bypass capacitors at zero volts.

The integrated hot swap connector pins arrangement 180A illustrated in FIGS. 3 and 4 also prevents current chopping when a board/LRM is pulled-out while there is a load current, in a normal or fault situation. Hence, the protection circuit shown in FIG. 4 prevents current chopping and also eliminates large transient voltages due to inductive current variations Ldi/dt. Pulling a board out without the hot swap protection while there is inductive current passing through connector pins may cause current chopping which results in arcing and excessive voltage/current transients. Inductive current may be due to on-board inductive filters or inductive loads, for example. Arcing and excessive voltage/current transients can have severe safety consequences due to risk of voltage shock to personnel or to other subsystems during failure modes or faulty conditions, such as short circuit conditions.

The speed of insertion/extraction of DC SSPC LRM 40A from backplane 104 may be manually controlled, or may be controlled by springs attached to the male or female pins of the integrated hot swap connector pins arrangements in FIG. 4. If the speed of insertion/extraction of DC SSPC LRM 40A from backplane 104 is not controlled, for example, if insertion/extraction of DC SSPC LRM 40A from backplane 104 is performed too fast, additional hot swap protection blocks can be included for backplane 104 connecting to female pins $L_2$, . . . ,$L_N$, or in DC SSPC LRM 40A connecting to power connector 225, as described in the co-pending non-provisional application titled "Method and Apparatus for Hot Swap of Line Replaceable Modules for AC and DC Electric Power Systems", the entire contents of which are hereby incorporated by reference. Such additional hot swap protection blocks can perform hot swap protection for LRMs, backplane connectors, etc.

In FIG. 4, multiple integrated hot swap connector pins arrangements may be present to achieve a more uniform hot swap in a discrete fashion. A plurality of male pins like male pin 415 attached to DC SSPC LRM 40A can communicate with one or more female pins like female pin 418. The plurality of integrated hot swap connector pins arrangements may exhibit various pin lengths and various Rmax resistances of internal resistive cylindrical shells of the female pins, to obtain additional levels of protection during hot swap.

Figure 5:
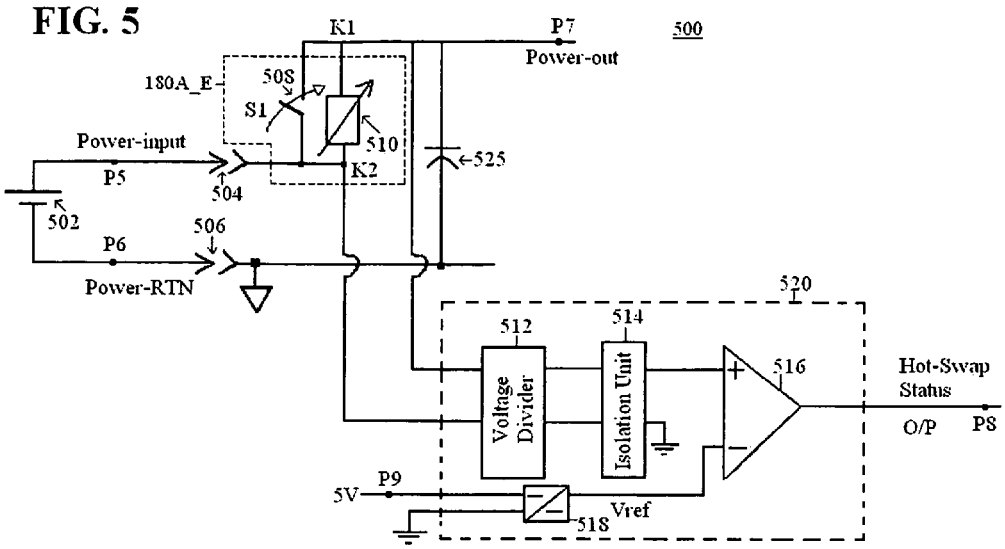
FIG. 5 is a block diagram of an electrical configuration illustrating aspects of the operation of an integrated hot swap connector pins arrangement for detection of hot swap of line replaceable modules for DC input power according to an embodiment of the present invention illustrated in FIG. 3.

FIG. 5 is a block diagram of an electrical configuration 500 illustrating aspects of the operation of an integrated hot swap connector pins arrangement 180A for detection of hot swap of line replaceable modules for DC input power according to an embodiment of the present invention illustrated in FIG. 3. Block 180A_E in FIG. 5 is a conceptual circuit using a variable resistor for illustrating aspects of the operation of an integrated hot swap connector pins arrangement 180A. The equivalent circuit 180A_E for integrated hot swap connector pins arrangement 180A includes an equivalent switch S1 508 and an equivalent variable resistor 510 with maximum resistance Rmax. The variable resistor 510 models the resistance variation of integrated hot swap connector pins arrangement 180A with pin motion.

When insertion of male pin 415 into female pin 418 is commenced, joined connectors 504 and 506 are connected. A DC power source 502 powers the circuit in FIG. 5. The following discussion references the description of the integrated hot swap connector pins arrangement 180A from FIG. 3. The resistance of variable resistor 510 is dependent on the position of the male pin 415 inside female pin 418, as described at FIG. 3.

During an initial step, the male pin 415 starts insertion into female pin 418 on a distance x, where $x \ll L1$, where L1 is the length of interval I of female pin 418. During this initial step, the resistance of integrated hot swap connector pins arrangement 180A is $R \approx Rmax$. Hence, in the equivalent circuit 180A_E for integrated hot swap connector pins arrangement 180A, equivalent switch S1 is open.

During an intermediate insertion step, the male pin 415 is further inserted into female pin 418 on a distance x, where $0<x<L1$, where L1 is the length of interval I of female pin 418. During this intermediate step, the resistance R of integrated hot swap connector pins arrangement 180A varies from Rmax to 0, $Rmax>R>0$, with resistance R of integrated hot swap connector pins arrangement 180A gradually decreasing as the male pin 415 is being inserted into female pin 418.

During a final insertion step, the male pin 415 is further inserted into female pin 418 on a distance x, where $x>L1$, where L1 is the length of interval I of female pin 418. During this final insertion step, the resistance R of integrated hot swap connector pins arrangement 180A is zero, as conductive region 406 ensures a solid and efficient electrical connection between the male pin 415 and the female pin 418, as illustrated in FIG. 3. Hence, in the equivalent circuit 180A_E for integrated hot swap connector pins arrangement 180A, equivalent switch S1 is closed.

A capacitor 525 connected at the Power-out line passes lower frequencies and stops high frequencies. A voltage divider 512 is connected to the Power-out line and to the equivalent resistor 510. The voltage divider 512 may output a voltage proportional to equivalent resistor 510. The signal from voltage divider 512 passes through an isolation unit 514, and is then amplified by an amplifier 516.

The block diagram of electrical configuration 500 in FIG. 5 illustrates how hot swap detection status is achieved for a DC input power, using integrated hot swap connector pins arrangement 180A. The output of amplifier 516 contains information about hot swap status. For example at the beginning of insertion of male pin 415 in female pin 418, the voltage from equivalent resistor 510 is large, because equivalent switch S1 is open. Hence, the output signal of amplifier 516 at point P8 is high, if the amplifier 516 is non-inverting, for example. On the other hand, at the completion of insertion of male pin 415 in female pin 418, the voltage from equivalent resistor 510 is zero, because equivalent switch S1 is closed and equivalent resistor 510 is bypassed. Hence, the output signal of amplifier 516 at point P8 is low, if the amplifier 516 is non-inverting.

In the diagram in FIG. 5, if resistor 510 were not a variable resistor, but a fixed resistor with resistance Rmax, then the resistance between points K1 and K2 would change abruptly between 2 values (0 and Rmax), approximating the effect of a long/short pin system with an external resistor.

Figure 6:
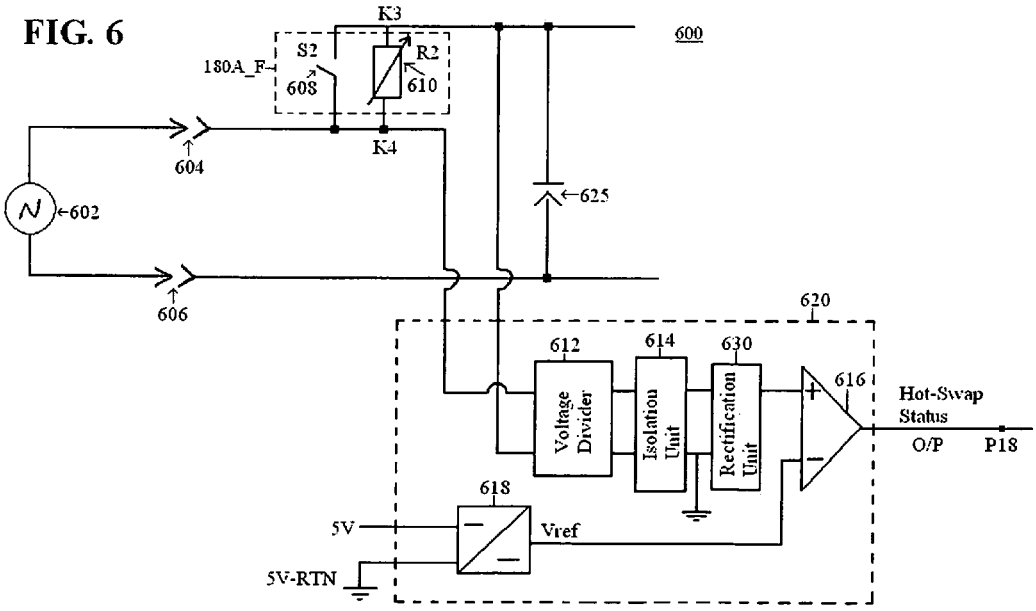
FIG. 6 is a block diagram of an electrical configuration illustrating aspects of the operation of an integrated hot swap connector pins arrangement for detection of hot swap of line replaceable modules for AC input power according to an embodiment of the present invention illustrated in FIG. 3.

FIG. 6 is a block diagram of an electrical configuration 600 illustrating aspects of the operation of an integrated hot swap connector pins arrangement 180A for detection of hot swap of line replaceable modules for AC input power according to an embodiment of the present invention illustrated in FIG. 3. Block 180A_F in FIG. 6 is a conceptual circuit using a variable resistor for illustrating aspects of the operation of an integrated hot swap connector pins arrangement 180A. The equivalent circuit 180A_F for integrated hot swap connector pins arrangement 180A includes an equivalent switch S2 608 and an equivalent variable resistor 610 R2 with maximum resistance Rmax. The variable resistor 610 R2 models the resistance variation of integrated hot swap connector pins arrangement 180A with pin motion.

When insertion of male pin 415 into female pin 418 is commenced, joined connectors 604 and 606 are connected. An AC power source 602 powers the circuit in FIG. 6. The following discussion references the description of the integrated hot swap connector pins arrangement 180A from FIG. 3. The resistance of variable resistor 610 is dependent on the position of the male pin 415 inside female pin 418, as described at FIG. 3.

During an initial step, the male pin 415 is inserted into female pin 418 on a distance x, where $x \ll L1$, where L1 is the length of interval I of female pin 418. During this initial step, the resistance of integrated hot swap connector pins arrangement 180A is $R \approx Rmax$. Hence, in the equivalent circuit 180A_F for integrated hot swap connector pins arrangement 180A, equivalent switch S2 is open.

During an intermediate insertion step, the male pin 415 is further inserted into female pin 418 on a distance x, where $0<x<L1$, where L1 is the length of interval I of female pin 418. During this intermediate step, the resistance R of integrated hot swap connector pins arrangement 180A varies from Rmax to 0, $Rmax>R>0$, with resistance R of integrated hot swap connector pins arrangement 180A gradually decreasing as the male pin 415 is being inserted into female pin 418.

During a final insertion step, the male pin 415 is further inserted into female pin 418 on a distance x, where $x>L1$, where L1 is the length of interval I of female pin 418. During this final insertion step, the resistance R of integrated hot swap connector pins arrangement 180A is zero, as conductive region 406 ensures a solid and efficient electrical connection between the male pin 415 and the female pin 418, as illustrated in FIG. 3. Hence, in the equivalent circuit 180A_F for integrated hot swap connector pins arrangement 180A, equivalent switch S2 is closed.

A capacitor 625 connected at the Power-out line passes lower frequencies and stops high frequencies. A voltage divider 612 is connected to the Power-out line and to the equivalent resistor 610. The voltage divider 612 may output a voltage proportional to equivalent resistor 610. The signal from voltage divider 612 passes through an isolation unit 614 and a rectification unit 630, and is then amplified by an amplifier 616.

The block diagram of electrical configuration 600 in FIG. 6 illustrates how hot swap detection status is achieved for an AC input power, using integrated hot swap connector pins arrangement 180A. The output of amplifier 616 contains information about hot swap status. For example at the beginning of insertion of male pin 415 in female pin 418, the voltage from equivalent resistor 610 is large, because equivalent switch S2 is open. Hence, the output signal of amplifier 616 at point P18 is high, if the amplifier 616 is non-inverting, for example. On the other hand, at the completion of insertion of male pin 415 in female pin 418, the voltage from equivalent resistor 610 is zero, because equivalent switch S2 is closed and equivalent resistor 610 is bypassed. Hence, the output signal of amplifier 616 at point P18 is low, if the amplifier 616 is non-inverting.

In the diagram in FIG. 6, if resistor 610 R2 were not a variable resistor, but a fixed resistor with resistance Rmax, then the resistance between points K3 and K4 would change abruptly between 2 values (0 and Rmax), approximating the effect of a long/short pin system with an external resistor.

Although the integrated hot swap connector pins arrangements discussed in FIGS. 1, 2, 3, 4, 5, and 6 were discussed in the context of AC and DC SSPC LRMs, the hot swap protection systems in FIGS. 1, 2, 3, 4, 5, and 6 are equally applicable to hot swap protection of other types of modules, circuits, and systems.

While an exemplary geometry for integrated hot swap connector pins arrangement 180 was presented in FIG. 3, other geometries and mechanical implementations are possible for integrated hot swap connector pins arrangement 180, to achieve the gradual variation of resistance during pin insertion and extraction described in the current application.

The integrated hot swap connector pins arrangements discussed in the current application integrate multiple long/short pin arrangements and multiple resistors into one pin, to achieve soft-start/stop for insertion and extraction of replaceable modules. The integrated hot swap connector pins arrangements discussed in the current application perform hot swap protection functions that would otherwise require multiple long/short pin arrangements with different pin lengths for the short pins, and multiple resistors connected to the long/short pin arrangements. Hence, the integrated hot swap connector pins arrangement 180A may be a one-step system or a multiple step system. A one-step integrated hot swap connector system integrates a long/short pin arrangement and a resistor into one integrated hot swap connector pins arrangement, to achieve soft-start/stop for insertion and extraction of replaceable modules. A multiple-step integrated hot swap connector system integrates multiple long/short pin arrangements and multiple resistors into one integrated hot swap connector pins arrangement, to achieve soft-start/stop for insertion and extraction of replaceable modules.

The timing of boards/LRMs insertion/extraction process can be controlled by the stiffness of a mechanical spring system, which may be incorporated into an integrated hot swap connector pins arrangement 180A and used to oppose the direction of pin motion. A preferred mode of operation for integrated hot swap connector pins arrangement 180A is to achieve soft-start through a uniformly varying resistive channel for which the resistance is gradually reduced during pin insertion, from a large resistance value (pin not inserted) to a zero resistance value (pin fully inserted). During board/LRM extraction, the resistance variation is reversed. Hence during board/LRM insertion in-rush currents are eliminated, and during board/LRM extraction current chopping is reduced.

The integrated hot swap connector pins arrangements discussed in the current invention can be used for hot swap of both low voltage and high voltage modules. Additional details regarding use of integrated hot swap connector pins arrangements for hot swap can be found in co-pending non-provisional application titled "Method and Apparatus for Hot Swap of Line Replaceable Modules for AC and DC Electric Power Systems", the entire contents of which are hereby incorporated by reference.

The integrated hot swap connector pins arrangements discussed in the current application effectively protect up/down stream subsystems and eliminate electrical current/voltage transients which would otherwise require complete shut-down of the larger electrical system before any hot swap can be achieved.

The hot swap methods and apparatuses using the integrated hot swap connector pins arrangements discussed in the current application can be implemented at three levels: at the level of basic hot swap, at the level of full hot swap, and at the level of highly available hot swap.

During basic hot swap, console intervention signals the electrical system 100 that a card/replaceable module is about to be removed or inserted. If the module is being taken out, the OS can gracefully terminate running software, and then signal the card/module to disconnect itself and power down. The reverse happens when a card/module is inserted in electrical system 100. The card/module may also be enumerated and mapped by electrical system 100.

During full hot swap, the method by which the operating system of electrical system 100 is told of the impending insertion or extraction of a board/module is predefined. A micro-switch attached to the card injector/ejector, or to an integrated hot swap connector pins arrangement 180, can give an early-warning signal to the system that an operator is about to remove a card. Software and hardware disconnect processes follow the switch activation. The enumeration interrupt can also inform the operating system of the electrical system 100 of the impending event. After the OS has terminated the board's functions, the interrupt signals to the operator that the board/module can be removed. On the other hand, when a new board is installed, the OS can automatically configure the system software of electrical system 100. This signaling method allows the operator to install or remove boards/modules without reconfiguring the system at the console.

During highly available hot swap, a hot swap controller with capacity to reconfigure software in a running system in electrical system 100 is used. Software and hardware components can be reconfigured automatically under application control. Console commands or ejector-switch activation and board/module removal usually unload the driver or install a new driver. By allowing software to control the board's state, both performance and system complexity of electrical system 100 are increased. Control lines to the CPU of electrical system 100 can inform the operating system (OS) that a board/module is present. The OS can then apply power to the board/module. Next, the hardware connection layer indicates that the board is powered up. The master system controller then signals to release the board/module from reset and connects it to the bus. Individual boards/modules can be identified and shut down, and others can be brought up in their place.

The integrated hot swap connector pins arrangement 180 and the apparatuses presented in FIGS. 1, 2, 3, 4, 5, and 6 achieve soft-switching, soft-start/soft-power-up and soft-stop/soft-power-down to eliminate arcing, random pin arcing, etc., and AC or DC current and v/i transients during the MAKE or BREAK process; eliminate in-rush currents during initial insertion of a board/module with all bulk/bypass capacitors at zero volts; mitigate bus contentions; prevent current chopping when a board is pulled-out when there is a load current (in a normal or fault situation); achieve controlled di/dt or dv/dt transients, for transient currents $i(t)=C(dv/dt)$ and transient voltages $v(t)=L(di/dt)$; eliminate large transient voltages due to $v(t)=L(di/dt)$ and current chopping causing excessive voltage/current transients resulting in severe safety consequences during failure modes; can incorporate circuit breaker functions for additional safety considerations; provide fault tolerance for safety considerations; can be implemented with sequencing control; can be implemented with diagnostics and health monitoring/reporting; mitigate fault challenges including ESD protection; can be integrated into electrical system 100 with a high level of integration in hardware, software and in the operating system; and properly detect the process of a board/LRM insertion or extraction so that S/W is gracefully shut-down to prevent abnormal operation and/or physical damage to sensitive interface circuitry. This type of "prior-to-event" detection prevents disturbance to various discrete signal/control data lines or communication bus activities. Also, proper power sequencing is presented for boards/LRMs with multiple logic power supply voltages and low and high DC voltages and AC sources of power. For proper operation of control circuitry, logic power is connected first and disconnected last.

Although some aspects of the present invention have been described in the context of aerospace applications, it should be realized that the principles of the present invention are applicable to other environments.

I claim:

1. A pin system for AC and DC electric power systems, said pin system comprising:

a female pin, said female pin comprising a resistive region, said resistive region forming a first portion of an inner surface of said female pin, a conductive region, said conductive region forming a second portion of said inner surface of said female pin, said conductive region contacting said resistive region, said conductive region being located further than said resistive region from an open end of said female pin, and an insulating region covering a portion of an external surface of said resistive region; and a male pin adapted to be inserted in said female pin along said inner surface of said female pin, said male pin being made of a conductive material.

2. The pin system according to claim 1, wherein resistance of said pin system varies in a continuous manner as said male pin is inserted into said female pin along said resistive region and said conductive region of said female pin, and as said male pin is extracted from said female pin along said conductive region and said resistive region of said female pin.

3. The pin system according to claim 1, wherein resistance of said pin system increases in a continuous manner as said male pin is extracted from said female pin along said conductive region and said resistive region of said female pin.

4. The pin system according to claim 1, wherein resistance of said pin system decreases linearly with increasing length of contact between said male pin and said resistive region of said female pin.

5. The pin system according to claim 1, wherein resistance of said pin system increases linearly with decreasing length of contact between said male pin and said resistive region of said female pin.

6. The pin system according to claim 1, wherein resistance of said pin system becomes relatively low or zero when said male pin contacts said conductive region of said female pin.

7. The pin system according to claim 1, wherein said female pin, said resistive region, and said conductive region of said female pin are cylindrical.

8. The pin system according to claim 1, wherein said male pin is attached to a replaceable module, said female pin is attached to an electrical motherboard, and resistance of said pin system decreases in a continuous manner as said male pin is inserted into said female pin along said resistive region and said conductive region of said female pin, eliminating in-rush current, current transients, and voltage transients occurring during how swap insertion of said replaceable module into said electrical motherboard.

9. The pin system according to claim 1, wherein said male pin is attached to a replaceable module, said female pin is attached to an electrical motherboard, and resistance of said pin system increases in a continuous manner as said male pin is extracted from said female pin along said conductive region and said resistive region of said female pin, eliminating current chopping, current transients, and voltage transients occurring during how swap extraction of said replaceable module from said electrical motherboard.

10. The pin system according to claim 1, wherein said insulating region forms a first portion of an external surface of said female pin.

11. The pin system according to claim 1, wherein said conductive region contacts an end connection of said female pin.

12. The pin system according to claim 1, wherein resistance of said pin system decreases in a continuous manner as said male pin is inserted into said female pin along said resistive region and said conductive region of said female pin.

13. The pin system according to claim 12, wherein resistance of said pin system becomes relatively low or zero when said male pin contacts said conductive region of said female pin.

14. An apparatus for hot swap of AC or DC line replaceable modules, said apparatus comprising:

a pin system, said pin system being connectable to a replaceable module and connectable to a backplane, said pin system comprising a female pin connectable to said backplane, said female pin comprising a resistive region forming a first portion of an inner surface of said female pin, and a conductive region forming a second portion of said inner surface of said female pin, said conductive region contacting said resistive region, said conductive region being located further than said resistive region from an open end of said female pin, and a male pin adapted to be inserted in said female pin along said inner surface of said female pin, said male pin being made of a conductive material, and said male pin being connectable to said replaceable module, wherein resistance of said pin system decreases in a continuous manner as said male pin is inserted into said female pin along said resistive region and said conductive region of said female pin; and a hot swap detector connectable to said pin system, said hot swap detector detecting disconnection of said replaceable module from said backplane, and detecting connection of said replaceable module to said backplane.

15. A method for hot swap of AC or DC line replaceable modules, said method comprising:

providing a female pin for connection to a backplane, said female pin comprising a resistive region comprising a first hollow cylindrical shell forming a first portion of an inner surface of said female pin, a conductive region comprising a second hollow cylindrical shell forming a second portion of said inner surface of said female pin, a start of a base of said conductive region contacting an end of a base of said resistive region, said conductive region being located further than said resistive region from an open end of said female pin, and an insulating region covering a portion of an external surface of said resistive region;

providing a male pin for connection to a line replaceable module, said male pin being adapted for insertion in said female pin along an inner hollow space of said female pin, said male pin being made of a conductive solid cylindrical material to fill said inner hollow space of said female pin;

decreasing a resistance between said line replaceable module and said backplane in a continuous manner as said male pin is inserted into said female pin along said resistive region and said conductive region of said female pin; and increasing a resistance between said line replaceable module and said backplane in a continuous manner as said male pin is extracted from said female pin along said conductive region and said resistive region of said female pin.

16. The method for hot swap of AC or DC line replaceable modules as recited in claim 15, said method eliminating in-rush current, current chopping, current transients, and voltage transients occurring during how swap of said line replaceable module.

17. The method for hot swap of AC or DC line replaceable modules as recited in claim 15, further comprising:

slowing down insertion and extraction of said male pin from said female pin and controlling how swap of said line replaceable module with an elastic force applied to one of said male pin and said female pin.

18. A method for hot swap of AC or DC line replaceable modules, said method comprising:

providing a female pin for connection to a backplane;

providing a male pin for connection to a line replaceable module, said male pin adapted to be inserted in said female pin;

decreasing a resistance between said line replaceable module and said backplane in a continuous manner as said male pin is inserted into said female pin along a resistive region of said female pin and a conductive region of said female pin;

increasing a resistance between said line replaceable module and said backplane in a continuous manner as said male pin is extracted from said female pin along said conductive region and said resistive region of said female pin; and detecting disconnection of said replaceable module from said backplane or detecting connection of said replaceable module to said backplane.

19. The method for hot swap of AC or DC line replaceable modules as recited in claim 18, said method eliminating in-rush current, current chopping, current transients, and voltage transients occurring during how swap of said line replaceable module.

20. The method for hot swap of AC or DC line replaceable modules as recited in claim 18, further comprising:

slowing down insertion and extraction of said male pin from said female pin and controlling how swap of said line replaceable module with an elastic force applied to one of said male pin and said female pin.

* * * * *